US008336791B1

(12) United States Patent
Parish

(10) Patent No.: US 8,336,791 B1
(45) Date of Patent: Dec. 25, 2012

(54) INSERT ASSEMBLY FOR A NOZZLE

(75) Inventor: James M. Parish, Akron, OH (US)

(73) Assignee: J.M. Parish Enterprises, LLC, Akron, OH (US)

( * ) Notice: Subject to any disclaimer, the term of this patent is extended or adjusted under 35 U.S.C. 154(b) by 254 days.

(21) Appl. No.: 12/807,440

(22) Filed: Sep. 7, 2010

(51) Int. Cl.
*B05B 1/04* (2006.01)

(52) U.S. Cl. ..... 239/594; 239/592

(58) Field of Classification Search ..... 239/589, 239/594, 593, 590, 591, 592, 569, 597
See application file for complete search history.

(56) References Cited

U.S. PATENT DOCUMENTS

| | | | | |
|---|---|---|---|---|
| 4,815,241 | A * | 3/1989 | Woodson | 451/102 |
| 4,952,218 | A | 8/1990 | Lipp et al. | 48/86 |
| 5,217,163 | A * | 6/1993 | Henshaw | 239/101 |
| 6,009,616 | A | 1/2000 | Gellert | 29/611 |
| 6,085,996 | A | 7/2000 | Culbertson et al. | 239/290 |
| 6,601,783 | B2 | 8/2003 | Chisum et al. | 239/433 |
| 6,625,873 | B1 | 9/2003 | Gellert | 29/611 |
| 6,769,901 | B2 | 8/2004 | Babin et al. | 425/549 |
| 2005/0173553 | A1 * | 8/2005 | Bjorn et al. | 239/11 |

OTHER PUBLICATIONS 2 pages of literature from StoneAge, Inc. (2008), 466 S. Skylane Drive, Durango, CO 81303.

* cited by examiner

*Primary Examiner* — Davis Hwu
(74) *Attorney, Agent, or Firm* — Renner, Kenner, Greive, Bobak, Taylor & Weber

(57) ABSTRACT

An insert assembly for use in a nozzle, the insert assembly including a sleeve and a fitting. The sleeve includes a first end and a second end, a tapered opening in the first end, and a bore extending from the second end. The fitting is positioned within the bore and includes an orifice therethrough. The tapered opening terminates at an inner opening that is in fluid communication with the orifice to allow fluid to flow through the nozzle insert. The sleeve may be made of stainless steel.

14 Claims, 3 Drawing Sheets

INSERT ASSEMBLY FOR A NOZZLE

TECHNICAL FIELD

This invention relates to an insert assembly for use in a high pressure nozzle. More particularly, this invention relates to such an insert assembly that includes a sleeve with a tapered opening and a fitting received in the sleeve.

BACKGROUND ART

High pressure nozzles are used in a variety of fields and for a variety of purposes. For example, high pressure nozzles are used to clear blockages within pipes, to wash debris out of pipes, and to polish the internal surfaces of pipes by forcing a nozzle attached to the end of a hose through the pipe. The pressure within such nozzle systems is relatively high, thereby applying significant forces to the internal orifices of the nozzle, which results in a limited nozzle life. Pressures of these types of nozzle systems are generally between 1500 and 3600 psi, but may be greater than 40,000 psi in some systems.

A number of different types of nozzles and nozzle assemblies are commercially available, each having advantages and disadvantages. One-piece nozzles are the most common type of nozzles. Typically made of stainless steel, these one-piece nozzles are generally the least expensive to manufacture. However, because the nozzle is provided as a single piece, the entire nozzle must be replaced once the high forces acting on the internal orifices have caused sufficient damage to effect the performance of the nozzle.

Other nozzles are designed having a body and an insert, the insert being threaded, press fit or mechanically attached to the body. The inserts are replaceable, and include the narrow orifice through which the water is forced to create an increase in pressure. This orifice is the part of the nozzle that wears out over time due to erosion from the water stream and particles within the water stream, corrosion, and rough handling. Thus, by providing the orifice in an insert of the nozzle, only a part of the nozzle must be replaced periodically.

High performing nozzles include inserts that have a tapered entrance opening which results in improved fluid flow and improved performance of the nozzle. These high performance nozzles do not present manufacturing difficulties when they are made of stainless steel because it is easily machined to accurate dimensions. In high pressure applications it is preferable to make the nozzle insert out of carbide because carbide is a harder material and offers greater resistance to the erosion caused by the high pressure flow. However, unlike stainless steel, carbide is extremely difficult to machine. Therefore, carbide nozzle inserts are currently cast to the desired shape, including a tapered entrance opening, to minimize the machining required. The orifice of the insert can be cast to size, or can be formed by using practices such as wire EDM. The outer surface of the cast fitting is sometimes ground for smoothness, or ground for an accurate press fit. The cost of manufacturing these fittings is high because each nozzle is cast individually.

Thus, the need exists for a high performance insert assembly that has an increased life span but is relatively easy and inexpensive to manufacture.

DISCLOSURE OF THE INVENTION

It is thus an object of one aspect of the present invention to provide an insert assembly including a sleeve and a fitting.

It is an object of another aspect of the present invention to provide an insert assembly, as above, that includes a tapered opening in the sleeve of the assembly, and a narrow orifice through the fitting.

It is an object of another aspect of the present invention to provide an insert assembly, as above, wherein the sleeve of the assembly is made of stainless steel.

It is an object of another aspect of the present invention to provide a method of manufacturing an insert assembly including casting an elongate carbide tube, and cutting the tube into multiple fittings.

These and other objects of the present invention, as well as the advantages thereof over existing prior art forms, which will become apparent from the description to follow, are accomplished by the improvements hereinafter described and claimed.

In general, an insert assembly according to the concepts of the present invention includes a sleeve having a first end surface and a second end surface opposed from the first end surface. A tapered opening is provided in the first end surface, and a bore extends partially through the sleeve from the second end surface. A fitting is positioned within the bore, the fitting having an orifice therethrough, which is in fluid communication with the tapered opening.

In accordance with another aspect of the present invention, an insert assembly includes a sleeve having a first end and a second end. A tapered opening extends from the first end and terminates at an inner opening, and a bore extends from the second end and terminates at an end wall. A fitting is positioned within the bore and has an orifice extending therethrough, the inner opening of the tapered surface providing an opening through the end wall.

In accordance with another aspect of the present invention, a method of manufacturing an insert assembly includes the steps of machining a stainless steel sleeve having a tapered opening and a bore, casting a carbide tube having an orifice extending longitudinally therethrough, cutting the carbide tube at a plurality of longitudinally spaced locations to create a plurality of fittings, and securing the fittings within the bore in the sleeve to create a nozzle insert.

A preferred exemplary nozzle insert assembly according to the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

An insert assembly for use in a nozzle made in accordance with the present invention is indicated generally by the numeral 10. Insert assembly 10 includes a sleeve 12 and a fitting 14 positioned within the sleeve 12. Sleeve 12 is made of an easily machined material to reduce manufacturing costs. Fitting 14 is made of a hard material capable of resisting the forces resulting from the increased velocity of fluid passing therethrough. While the embodiment of the invention described herein contemplates use of carbide to make the fitting, it should be appreciated that alternative materials that possess the required hardness and wear resistance may be used.

Figure 1:
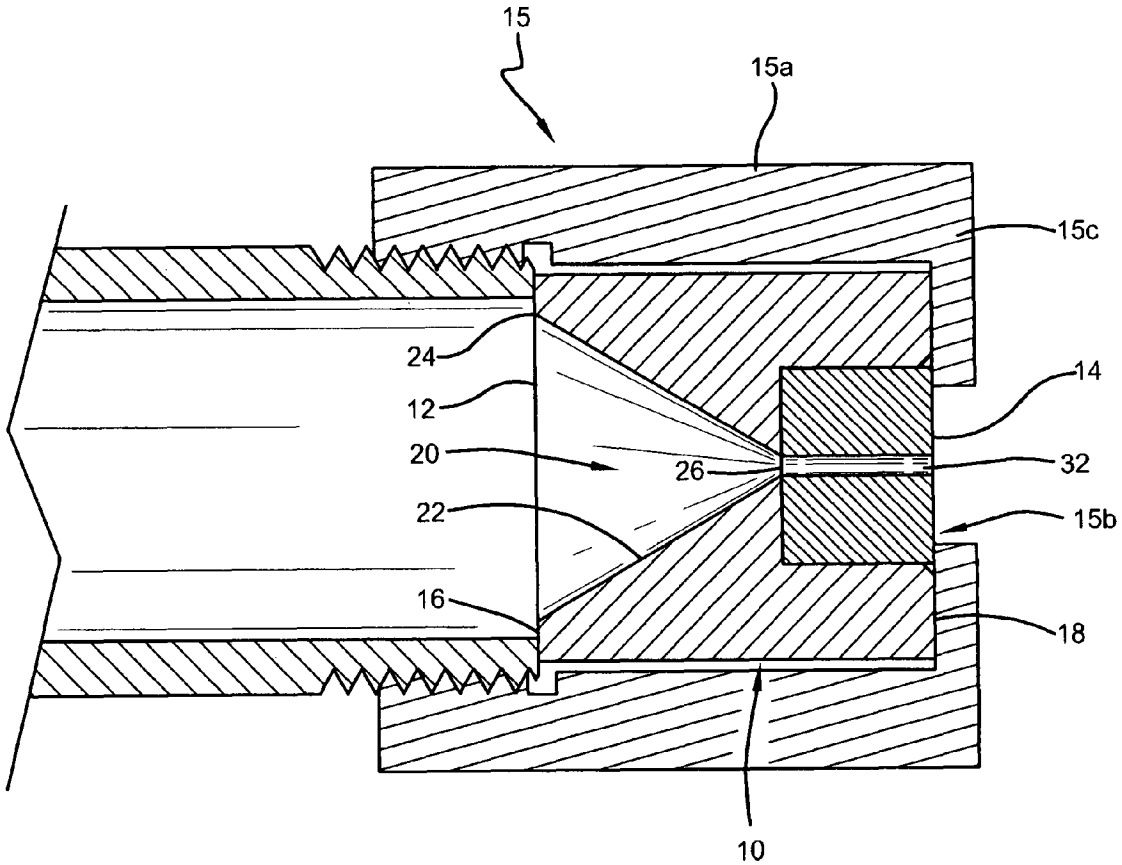
FIG. 1 is a sectional view of a nozzle including an insert assembly according to the concepts of the present invention.
Figure 2:
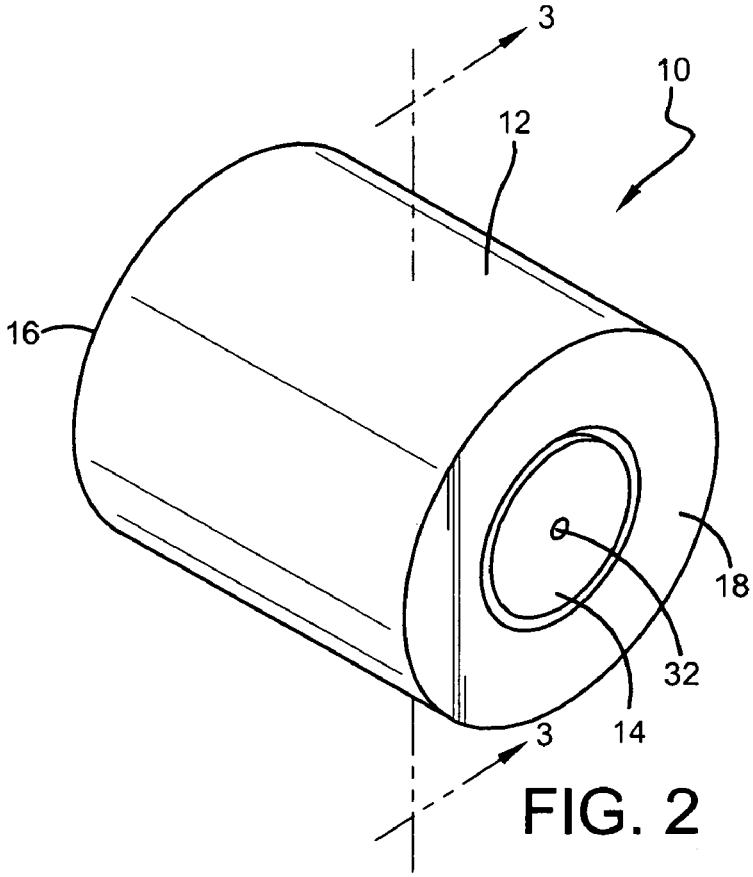
FIG. 2 is a perspective view of the insert assembly of FIG. 1 showing the end having a fitting.
Figure 3:
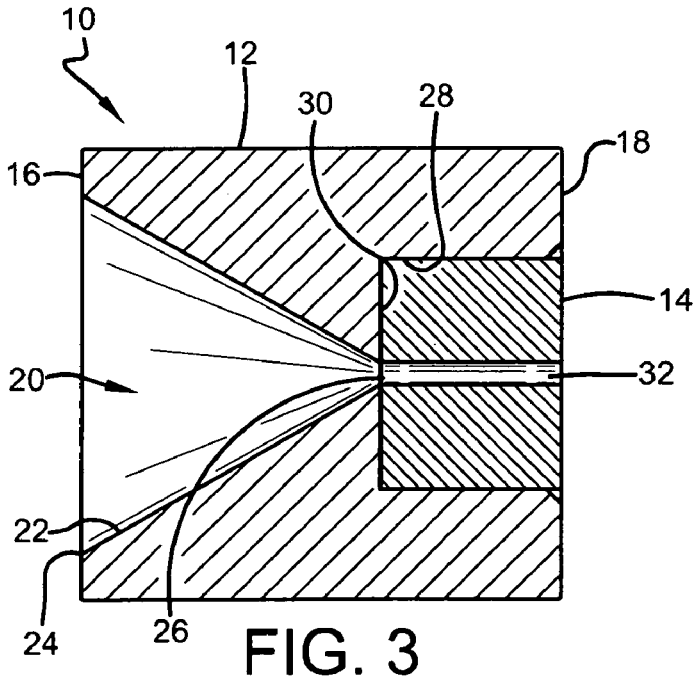
FIG. 3 is a sectional view taken substantially along the line 3-3 of FIG. 2.
Figure 4:
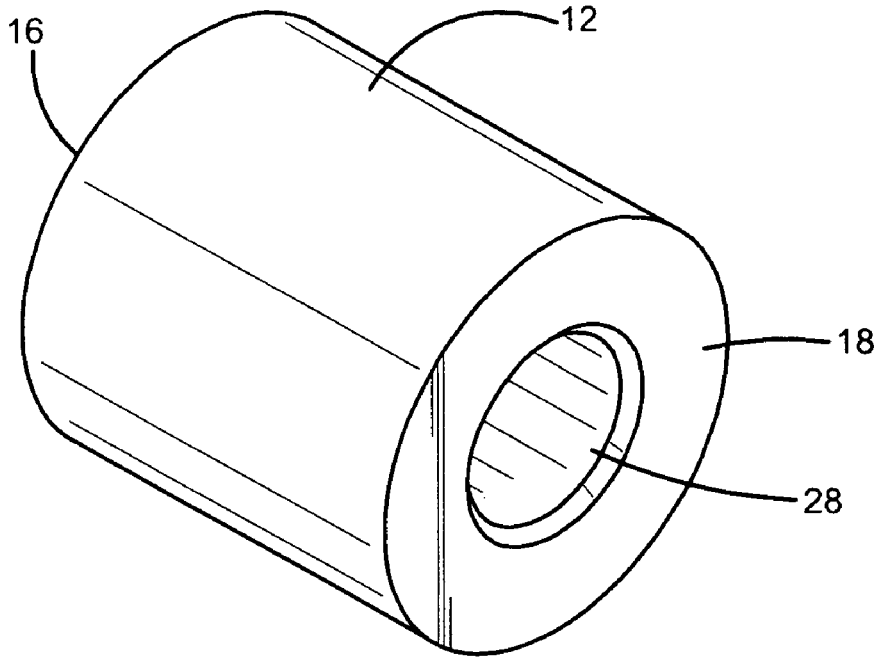
FIG. 4 is a perspective view of a sleeve of the insert assembly according to the concepts of the present invention.
Figure 5:
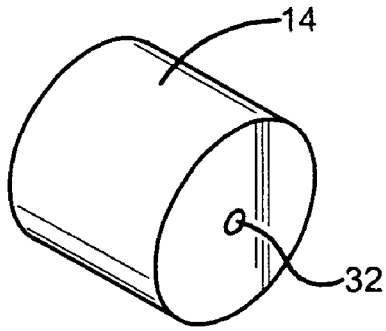
FIG. 5 is a perspective view of a fitting of the insert assembly according to the concepts of the present invention.

Insert assembly 10 is received in a nozzle body 15 (FIG. 1) and acts to restrict the flow of water or other fluids flowing through the nozzle. The reduced diameter of the opening through insert assembly 10 results in an increase in velocity and pressure of the fluid as travels therethrough. Nozzle body 15 may be any type capable of receiving an insert and known to those skilled in the art. In the embodiment shown, nozzle body 15 includes a threaded cap 15*a* having an open end 15*b* defined by an inwardly extending lip 15*c*. Lip 15*c* acts to prevent insert assembly 10 from being forced out through the open end 15*b* of nozzle body 15.

Sleeve 12 is generally cylindrical and includes a first end 16 and an opposing second end 18. The diameter of sleeve 12 may vary depending upon the nozzle body 15 that insert assembly 10 will be positioned in, but in certain embodiments may be between approximately 0.25 and 0.50 inches. It should be appreciated, however, that sleeve 12 may have any desired outer geometry without deviating from the scope of the present invention, unless so claimed. Sleeve 12 may be made of any easily machined metals known to those skilled in the art, such as, for example, stainless steel, titanium, nickel alloys and heat-treated steel.

A tapered opening 20 is provided in first end 16 of sleeve 12. Tapered opening 20 includes a tapered surface 22 extending between an outer opening 24 and an inner opening 26. Tapered surface 22 is generally cone shaped and decreases in diameter as it extends from outer opening 24 to inner opening 26. The dimensions of outer opening 24 and inner opening 26 may vary depending upon the intended use and the pressure of the system in which insert assembly 10 is installed. In one embodiment, outer opening 24 may have a diameter of approximately 0.160 inches, and inner opening 26 may have a diameter of approximately 0.016 inches. A bore 28 extends partially through sleeve 12 from second end 18. Bore 28 terminates at an end wall 30 positioned within sleeve 12 and spaced from second end 18. Inner opening 26 of tapered opening 20 may be located in end wall 30, thereby providing an opening between tapered opening 20 and bore 28.

Fitting 14 is received in bore 28 of sleeve 12. Fitting 14 is generally cylindrical and includes an orifice 32 extending therethrough. Orifice 32 and inner opening 26 are substantially aligned when fitting 14 is positioned within bore 28. Orifice 32 may have a diameter that is approximately equal to inner opening 26. Thus, consistent with the dimensions provided above, in certain embodiments orifice 32 may have a diameter of approximately 0.016 inches. Fitting 14 may be secured within bore 28 in sleeve 12 by any method or mechanism known to those skilled in the art. For example, fitting 14 may be press fit into bore 28. In other embodiments, bore 28 may be provided with internal threads, and fitting 14 may be provided with external threads, the threads acting to secure fitting 14 within bore 28, as will be understood by those skilled in the art.

Tapered opening 20 funnels water or other fluids flowing through insert assembly 10 into orifice 32 of fitting 14. The fluid then flows through orifice 32 at an increased velocity before exiting insert assembly 10 and nozzle body 15 at high pressure. By providing a sleeve 12 with the tapered opening 20 and a separate fitting 14 with a narrow orifice 32, the benefits of the orifice 32 formed in carbide are provided in conjunction with the benefits of the tapered opening 20 without requiring expensive and complicated machining. The tapered opening 20 is easily machined in the stainless steel or other metal of sleeve 12, and the fitting 14, which is difficult to machine, has a simple geometry. Furthermore, by providing sleeve 12 and fitting 14 separately, one or both parts may be replaced as needed without requiring replacement of the entire nozzle or insert assembly 10.

The method of manufacturing fitting 14 may include first casting a tube. The tube may have a length of between approximately 1.0 and 12.0 inches, and includes an internal orifice extending therethrough. The tube may be ground to a specified diameter after casting. If required, the diameter of the orifice may be refinished using wire electric discharge machining (EDM). Once the tube is machined to the desired dimensions, the tube may be cut into multiple pieces along its longitudinal length to create multiple fittings 14. Thus, a single casting can result in a plurality of fittings. This method of manufacturing significantly reduces machining costs, thereby resulting in a less expensive insert assembly 10.

It is thus evident that a insert assembly constructed as described herein accomplishes the objects of the present invention and otherwise substantially improves the art.

What is claimed is:

1. An insert assembly for use in a nozzle comprising a sleeve having a first end surface and a second end surface opposed from said first end surface, said sleeve being received within a nozzle body, a tapered opening in said first end surface, a bore extending partially through said sleeve from said second end surface, and a fitting positioned within said bore and retained within said bore by a lip extending from said nozzle body and defining an opening, said fitting having an orifice therethrough, said orifice being in fluid communication with said tapered opening.

2. The insert assembly of claim 1, said tapered opening decreasing in size as it extends from said first end surface toward said second end surface.

3. The insert assembly of claim 1, said tapered opening terminating at an inner opening spaced from said first end surface.

4. The insert assembly of claim 3, said bore terminating at an end wall spaced from said second end surface, said inner opening providing a passage through said end wall.

5. The insert assembly of claim 4, said orifice and said inner opening having approximately equal diameters.

6. The insert assembly of claim 1, said fitting being press fit into said bore.

7. The insert assembly of claim 1, said sleeve being made of stainless steel.

8. The insert assembly of claim 1, said fitting being made of carbide.

9. An insert assembly for use in a nozzle comprising a sleeve having a first end and a second end, said sleeve being received within a nozzle body, a tapered opening extending from said first end and terminating at an inner opening, a bore extending from said second end and terminating at an end wall, and a fitting positioned within said bore and having an orifice extending therethrough, said fitting being retained within said bore by a lip extending from said nozzle body and defining an opening, said inner opening of said tapered surface providing an opening through said end wall.

10. The insert assembly of claim 9, said tapered opening having a tapered surface that decreases in diameter as it approaches said inner opening.

11. The insert assembly of claim 9, said orifice and said inner opening having approximately equal diameters.

12. The insert assembly of claim 9, said fitting being press fit into said bore.

13. The insert assembly of claim 9, said sleeve being made of stainless steel.

14. The insert assembly of claim 9, said fitting being made of carbide.

* * * * *